US006216319B1

(12) United States Patent
Elkins

(10) Patent No.: US 6,216,319 B1
(45) Date of Patent: Apr. 17, 2001

(54) TOOL TETHER

(76) Inventor: Oscar K. Elkins, 39424 Roslyn Dr., Sterling Heights, MI (US) 48313

( * ) Notice: Subject to any disclaimer, the term of this patent is extended or adjusted under 35 U.S.C. 154(b) by 0 days.

(21) Appl. No.: 09/375,985

(22) Filed: Aug. 16, 1999

(51) Int. Cl.[7] ..... A45F 5/00

(52) U.S. Cl. ..... 24/3.2; 24/3.7; 24/3.13; 224/221; 224/251; 224/904

(58) Field of Search ..... 24/3.4, 3.2, 3.7, 24/3.13; 224/219, 221, 904, 251

(56) References Cited

U.S. PATENT DOCUMENTS

| | | | | |
|---|---|---|---|---|
| 2,728,501 | | 12/1955 | Hill . | |
| 3,124,286 | | 3/1964 | Dompier . | |
| 3,294,299 | | 12/1966 | Brennan . | |
| 4,159,792 | | 7/1979 | Siegal . | |
| 4,322,077 | * | 3/1982 | Van't Hof | 224/220 X |
| 4,728,123 | | 3/1988 | Kassal et al. . | |
| 4,847,729 | | 7/1989 | Hee . | |
| 4,962,929 | | 10/1990 | Melton, Jr. . | |
| 5,027,477 | | 7/1991 | Seron . | |
| 5,082,156 | | 1/1992 | Braun . | |
| 5,332,240 | * | 7/1994 | Bedoian . | |
| 5,351,346 | | 10/1994 | Hodges, Jr. . | |
| 5,379,928 | * | 1/1995 | Mikkelsen . | |
| 5,397,039 | * | 3/1995 | Parcelles . | |
| 5,409,151 | * | 4/1995 | Freimark | 224/220 X |
| 5,600,873 | | 2/1997 | May . | |
| 5,609,281 | * | 3/1997 | West | 224/904 X |
| 5,680,679 | * | 10/1997 | May | 24/3.2 |
| 5,815,977 | * | 10/1998 | Hill, Jr. . | |
| 5,893,498 | * | 4/1999 | Aronson | 224/904 X |
| 5,910,004 | * | 6/1999 | Antosh . | |

* cited by examiner

*Primary Examiner*—James R. Brittain
(74) *Attorney, Agent, or Firm*—Harness, Dickey & Pierce, P.L.C.

(57) ABSTRACT

A tool tether that includes an adjustable lanyard having a loop that fits over a user's hand that can be tightened thereon. An opposite end of the lanyard from the loop includes a swivel clasping mechanism that can be connected to one of a plurality of hardware receptacles. The hardware receptacles include an eyelet or the like to allow it to be secured to the clasping mechanism. The hardware receptacles come in a wide variety of sizes to accommodate tools and hardware of different sizes and weights. In one embodiment, the hardware receptacles are cylindrically shaped rubber cups that are rigid enough to support different tools, and have different diameters. In an alternate embodiment, the hardware receptacles are flexible ring members that can be wrapped around a particular tool or component.

20 Claims, 2 Drawing Sheets

TOOL TETHER

BACKGROUND OF THE INVENTION

1. Field of the Invention

This invention relates generally to a tool tether for securing a tool or piece of hardware to a user and, more particularly, to an adjustable lanyard to be secured to a user's arm or otherwise that includes a swivel clasp for connecting one of a plurality of different sized receptacles to the lanyard to hold various tools and hardware to the user.

2. Discussion of the Related Art

As most professional and garage mechanics are aware, various tools, such as wrenches, pliers, screwdrivers, etc., or hardware, such as bolts, nuts, screws, spark plugs, pipe fittings, electrical connectors, etc., that are dropped while performing a job can be a great annoyance, inconvenience and possibly pose significant problems when working on various machines or devices. The problem of dropped tools occurs in many work environments, including auto mechanics, marine mechanics, aircraft mechanics, machine building, machine repairing, plumbing, heating and cooling installation and repair, carpentry, construction equipment repair, farm equipment repair, and electrical.

If the mechanic is working in a confined or tight area, the chance of dropping the tool or hardware increases. The dropped tool or hardware can fall within or behind structures or roll underneath things. The mechanic must then stop what he is doing, and retrieve the tool or hardware, causing delay and inconvenience. Sometimes, the tool or hardware may be irretrievable. Sometimes the problem of dropping the tool or hardware is repeated for the same particular operation. If a mechanic is working at a high location, such as on a ladder or the like, and he drops a tool, he must climb down from the location to search and locate the dropped tool. Furthermore, a dropped tool from a high height can damage the tool, damage equipment and machinery it hits, and could cause bodily injury to other individuals below.

Persons who may be physically impaired where one hand is non-functional as a result of injury, disease, birth defect, etc., may have problems holding and operating a certain tool or piece of hardware. Those persons may benefit from some type of device for securing the tool or piece of hardware to the person's body.

Different types of devices for securing tools to a user are known in the art. However, these types of devices can be improved upon by being more flexible to more easily and reliably hold a wider variety of tools and hardware. It is therefore an object of the present invention to provide an improved tool tether.

SUMMARY OF THE INVENTION

In accordance with the teachings of the present invention, a tool tether is disclosed that includes an adjustable lanyard having a loop that fits over a user's hand, and can be tightened to the user's arm. An opposite end of the lanyard from the loop includes a swivel clasping mechanism that can be connected to one of a plurality of hardware receptacles. Each of the hardware receptacles includes an eyelet or the like to allow it to be easily secured to the clasping mechanism. The hardware receptacles come in a wide variety of sizes and/or shapes to accommodate tools and hardware of different sizes and weights. In one embodiment, the hardware receptacles are cylindrical shaped rubber cups that are rigid enough to support tools of different sizes and shapes. In an alternate embodiment, the hardware receptacles are flexible ring members that can be elastically wrapped around a particular tool or piece of hardware.

Additional objects, features and advantages of the present invention will become apparent from the following description and the appended claims when taken in conjunction with the accompanying drawings.

DETAILED DESCRIPTION OF THE PREFERRED EMBODIMENTS

The following description of the preferred embodiments directed to a tool tether is merely exemplary in nature, and is in no way intended to limit the invention or its applications or uses.

Figure 1:
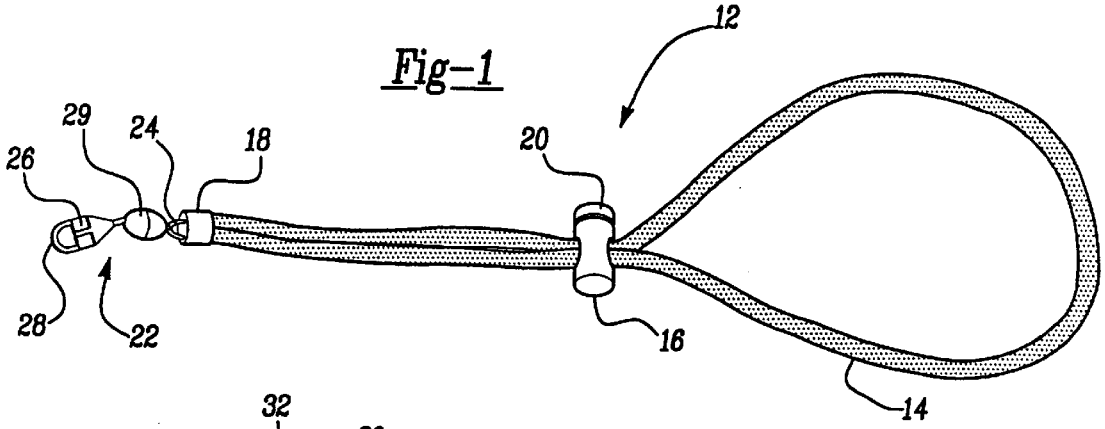
FIG. 1 is a perspective view of an adjustable lanyard that is part of a tool tether assembly, according to an embodiment of the present invention.

The present invention is a tool tether assembly 10 that secures a tool or piece of hardware to a user or a structure to prevent the tool or hardware from being dropped and falling away from the user when it is being used, or the hardware is being installed or removed. FIG. 1 is a perspective view of a tool tether lanyard 12 of the tool tether assembly 10 comprising a length of cord. The lanyard 12 can be made of any suitable material, such as rope, fiber, rubber, etc., as long as it is suitably durable and long lasting for the purposes described herein. The ends of the lanyard 12 are secured together to form a loop 14. In this embodiment, the ends of the lanyard 12 are inserted into a metal connecting cup 18, which is then crimped to the ends of the lanyard 12 to secure them together to define the loop 14. Other techniques for forming the loop 14 can also be used, including wrapping wire around the ends of the lanyard 12.

The size of the loop 14 is adjustable by a loop adjusting device 16. In this embodiment, the lanyard 12 is put through an opening in the device 16, and a spring-loaded member 20 associated with the device 16 is depressed to move the device along the lanyard 12. Various clasping devices can be used to readily and easily adjust the size of the loop 14, as would be appreciated by those skilled in the art. The device 16 allows the loop 14 to fit over a user's hand, and then be readily adjusted to a user's wrist to be secured thereto. It is not necessary to secure the lanyard 12 to the user's wrist in that it can be secured to any desirable location. For example, the loop 14 can be secured to other parts of the person's body, or other structures, such as faucets, radiator caps, car hood latches, door knobs, handles, machine protrusions, pipes, etc.

A hardware swivel clasping mechanism 22 is secured to an eyelet 24 proximate the bound ends of the lanyard 12, where the eyelet 24 is part of the cup 18. In this design, the clasping mechanism 22 is permanently secured to the lanyard 12, and forms part of it. The clasping mechanism 22 includes a clasp 26 having a spring-loaded pin 28 that can be readily opened and closed for securing a receptacle thereto, as will be discussed below. The clasping mechanism 22 includes a swivel mechanism 29 that allows the clasp 26 to swivel or rotate on the lanyard 12 to prevent twisting or binding of the lanyard 12. Any suitable clasping mechanism can be used for this purpose consistent with the discussion herein.

Figure 2A:
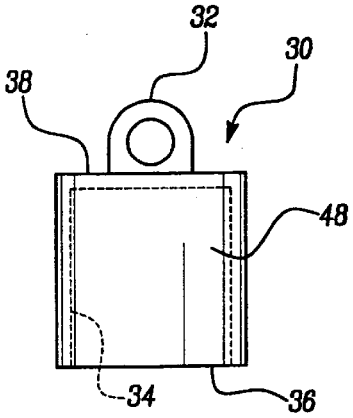
FIG. 2(A)–2(C) show a plurality of different sized cylindrical-shaped hardware receptacles that are separately connectable to the lanyard shown in FIG. 1.
Figure 2B:
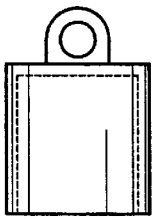
Figure 2C:
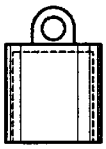
Figure 3:
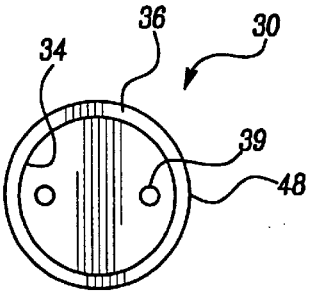
FIG. 3 is a bottom view of one of the receptacles shown in FIG. 2.

FIGS. 2(A)–2(C) show a plurality of hardware receptacles 30 of different sizes and diameters. FIG. 3 shows a bottom view of one of the receptacles 30. Each receptacle 30 includes an eyelet 32 defining an opening therethrough. The receptacles 30 are tubular members having a cylindrical chamber 34 of varying diameters and being capable of fitting over the end of tools and pieces of hardware of different sizes and shapes through an open end 36 of the receptacle 30. The hardware receptacles 30 generally have a thin wall 48 so as to be pliable and moldable to the various tools and components. In one embodiment, the receptacles 30 are made of a molded rubber, and are durable, rigid and easy to clean. The pliableness of the receptacles 30 enable the circular dimensions of the chamber 34 to conform to any shaped tool or piece of hardware. For example, the receptacle 30 can be readily molded to any shape including square, triangular, hexagonal, rectangular, elliptical, oval, half-circle, trapezoidal, parallelogram, pentagonal, octagonal, etc. Additionally, the receptacles 30 can be molded to irregular shapes.

The hardware receptacles 30 are selectively connected to the lanyard 12 by connecting the clasp 26 to the eyelet 32. The hardware receptacles 30 are configured to hold and secure various sized tools and components, such as pliers, wrenches, screwdrivers, nuts, bolts, spark plugs, pipe fittings, electrical connectors, etc. Of course, the receptacles 30 can include any type of structure and any suitable shape that allows it to be secured to the lanyard 12, within the scope of the present invention. Holes 39 extend through a top end 38 of the receptacles to provide vents that help alleviate suction that may occur when removing a tool or piece of hardware from the receptacles 30, thus making it easier to remove the hardware.

Figure 4A:
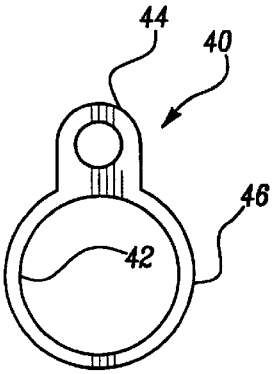
FIG. 4(A)–4(C) show a plurality of different sized tool rings that are also separately connectable to the lanyard shown in FIG. 1.
Figure 4B:
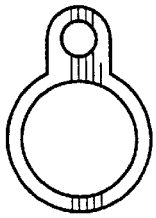
Figure 4C:
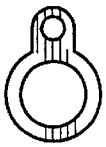

FIGS. 4(A)–4(C) show a plurality of hardware rings 40 that are also selectively securable to the lanyard 12. Each ring 40 includes an inner diameter 42 of varying sizes that allows it to be connectable to different types of tools and the like. The ring 40 is wrapped around the particular tool, such as the head of a wrench. The rings 40 are thin enough so that they are pliable to be readily attachable to the various tools and components, but are durable enough to stand up to the work environment. The tool ring 40 include an eyelet 44 that forms part of the ring at an outer diameter 46 of the ring 40, and define an opening to allow the clasping mechanism 18 to be secured thereto. In one embodiment, the rings 40 are made of molded rubber to be rigid and durable for the purposes described herein.

Figure 5:
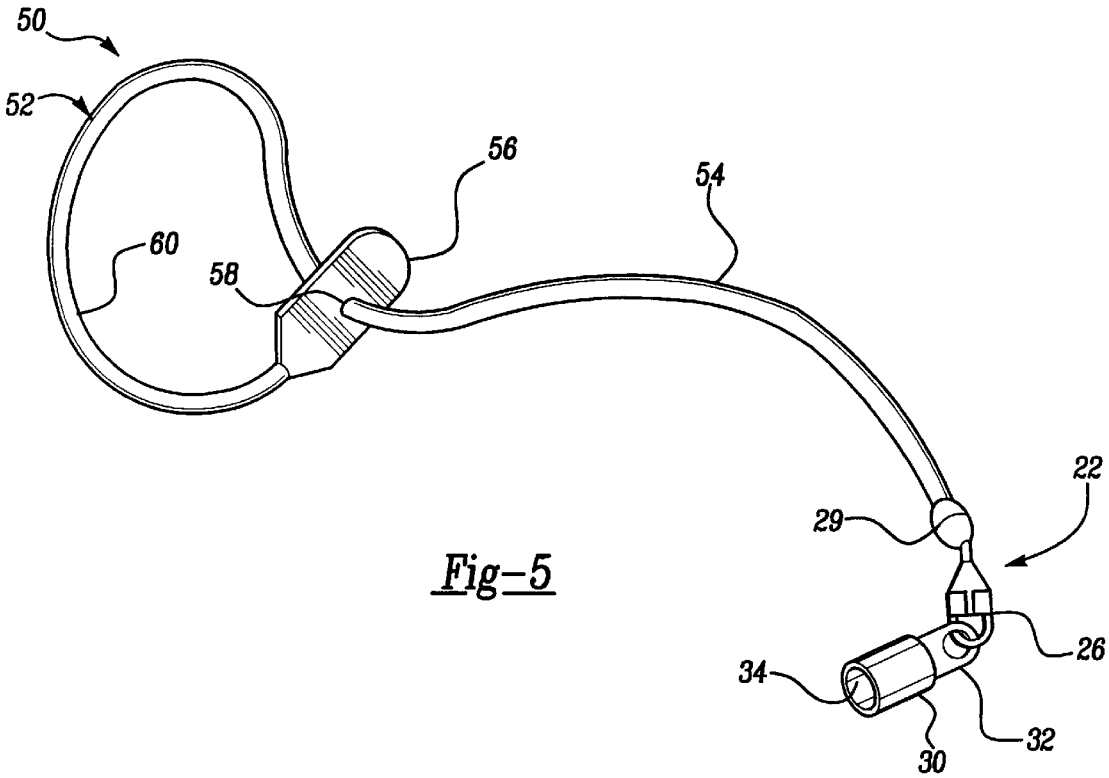
FIG. 5 is a perspective view of a tool tether assembly, according to another embodiment of the present invention.

FIG. 5 shows an alternate embodiment of a tool tether assembly 50, according to another embodiment of the present invention. The assembly 50 also includes a lanyard 52. The lanyard 52 includes a length of rubber cord 54 attached to the swivel mechanism 29 at one end, and having a rubber flap 56 at an opposite end. The flap 56 includes an opening 58 through which the cord 54 extends, as shown, to define a loop 60. The rubber-to-rubber friction engagement between the flap 56 and the cord 54 holds the loop 60 in its desired position. The flap 56 can be pulled along the cord 54 to change the size of the loop 60.

Figure 6:
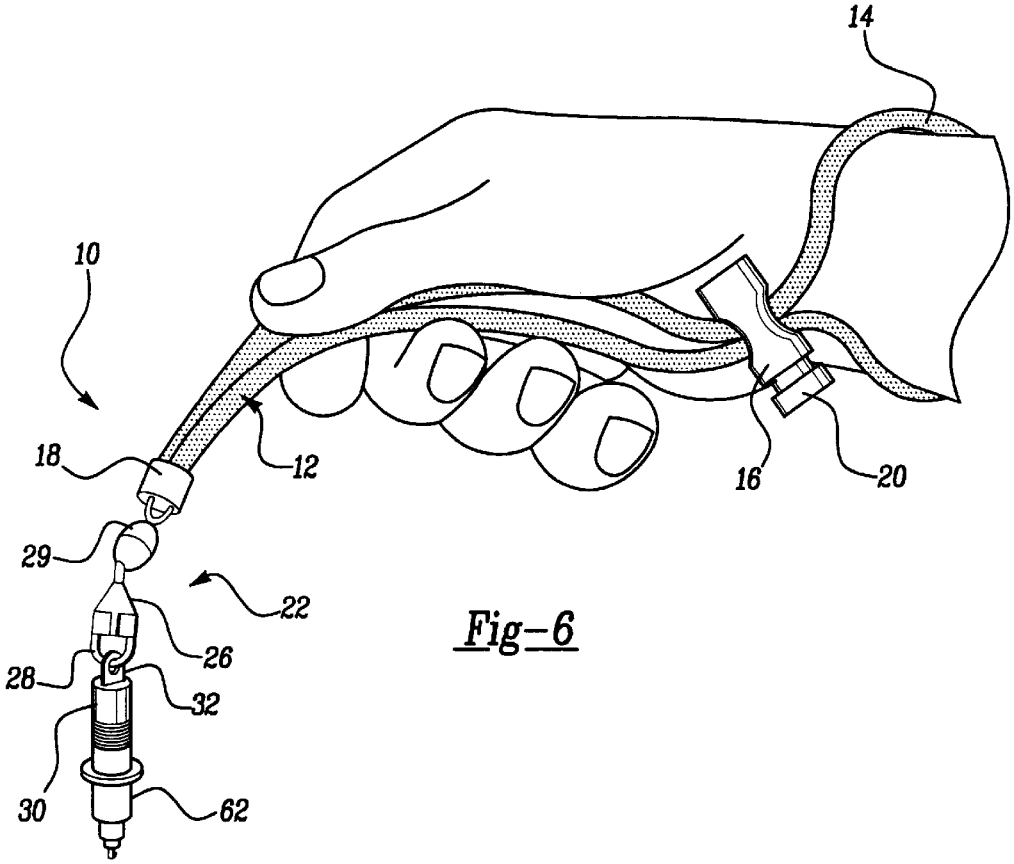
FIG. 6 is a perspective view of the tool tether assembly of the invention being used by a user.

FIG. 6 is a perspective view showing how the tool tether assembly 10 is used, according to the invention. In this example, a hardware receptacle 30 is being used, and is selected to have a size that fits over and be molded to an end of a spark plug 62 in a friction type fit. Other tools or hardware may require other sized receptacles 30 or use of the tool ring 40. The tool tether assembly 10 could be a kit that included the lanyard 12 and a number of different sized receptacles 30 and rings 40 for all types of tools and hardware.

In operation, the user selects a receptacle 30 which fits snugly over the head of a chosen piece of hardware. The receptacle 30, including the piece of hardware, is then connected to the lanyard 12. The user then puts his or her arm through the loop 14, and snugs it onto his wrist. The user then loosely installs the piece of hardware, removes the receptacle 30, and then finishes the installation with the appropriate tool. When removing a piece of hardware, the hardware is first loosened with a tool, and then a receptacle 30 is selected which fits snugly over the head of the particular hardware. The lanyard 12 is then connected to the receptacle 30, and then the user finishes removing the piece of hardware with his hand.

The foregoing discussion discloses and describes merely exemplary embodiments of the present invention. One skilled in the art will readily recognize from such discussion, and from the accompanying drawings and claims, that various changes, modifications or variations can be made therein without departing from the spirit and scope of the invention as defined in the following claims.

What is claimed is:

1. A tool tether assembly for securing a piece of hardware to a user, said assembly comprising:

a lanyard, said lanyard including a loop mechanism forming a loop in the lanyard that is configured to attach to the user's person;

a clasping mechanism secured to one end of the lanyard; and a hardware receptacle including a connector, said clasping mechanism being selectively securable to the connector so as to secure the receptacle to the lanyard, said receptacle being a cylindrical member having an internal channel, wherein said piece of hardware is rigidly securable within the channel in a friction fit.

2. The assembly according to claim 1 wherein the receptacle is made of a molded piece of rubber.

3. The assembly according to claim 2 wherein the walls of the receptacle are pliable so as to be readily moldable to the piece of hardware.

4. The assembly according to claim 1 wherein the connector is an eyelet formed as part of the receptacle at an end thereof opposite to an opening in the channel.

5. The assembly according to claim 1 wherein the loop mechanism is a connecting mechanism that is slidable along the length of the lanyard and is selectively secured to any location on the lanyard to change the size of the loop.

6. The assembly according to claim 1 wherein the lanyard is a length of rubber cord and the loop mechanism is a rubber flap secured to one end of the cord opposite to the clasping mechanism, said lanyard extending through an opening in the flap so as to define the loop, and wherein said flap is slidable along the length of the lanyard to change the size of the loop.

7. The assembly according to claim 1 wherein the lanyard is made of a material selected from the group consisting of rubber, string, and wire.

8. The assembly according to claim 1 further comprising at least one vent hole extending through a closed end of the receptacle opposite to an opening in the internal channel.

9. The assembly according to claim 1 wherein the clasping mechanism includes a swivel that allows the clasping mechanism to rotate on the lanyard.

10. A tool tether for securing a piece of hardware to a user, said tool tether comprising:

a lanyard, said lanyard including an adjusting device secured thereto and defining a loop in the lanyard, said adjusting device being selectively positionable along the lanyard to change the size of the loop;

a clasping mechanism secured to one end of the lanyard opposite to the loop, said clasping mechanism including a swivel to allow the clasping mechanism to rotate on the lanyard; and a cylindrical shaped hardware receptacle having an internal chamber and an opening to the chamber, said hardware receptacle including an eyelet secured to a top of the receptacle opposite to the opening of the chamber, said clasping mechanism being secured to the eyelet, wherein said piece of hardware can be rigidly securable within the chamber in a friction fit.

11. The tool tether according to claim 10 wherein the receptacle is made of rubber, and wherein the walls of the receptacle are pliable so as to be readily moldable to the piece of hardware.

12. The tool tether according to claim 10 wherein the lanyard extends through the adjusting device so that it is slidable along the length of the lanyard and is electively secured to any location thereon.

13. The tool tether according to claim 12 wherein the adjusting device is a rubber flap secured to an end of the lanyard opposite the clasping mechanism, and wherein the lanyard extends through an opening in the flap.

14. The tool tether according to claim 10 further comprising at least one vent hole extending through a closed end of the receptacle proximate the eyelet.

15. A tool tether kit for securing a tool or piece of hardware to a user, said kit comprising:

a lanyard, said lanyard including a loop device selectively positionable along the lanyard and forming an adjustable loop in the lanyard that is configured to fit over a user's hand and be snugged to a user's wrist, said lanyard further including a swivel clasping mechanism secured to one end of the lanyard opposite to the loop; and a plurality of cylindrical-shaped hardware receptacles, each receptacle including an internal chamber accessible through an opening in the receptacle, wherein each chamber has a different diameter, each receptacle further including a connecter, each receptacle being separately securable to the lanyard by attaching the clasping mechanism to the connecter to allow different sized tools or hardware to be secured to the user.

16. The kit according to claim 15 wherein each hardware receptacle is made of a molded piece of rubber.

17. The kit according to claim 15 wherein the loop device is slidable along the length of the lanyard and is selectively secured to any location on the lanyard.

18. The kit according to claim 17 wherein the loop device is a flap secured to one end of the lanyard opposite to the clasping mechanism, said lanyard extending through an opening in the flap that defines the loop.

19. The kit according to claim 15 wherein each receptacle includes a vent hole extending through a closed end of the receptacle.

20. The kit according to claim 15 further comprising a plurality of hardware rings, each hardware ring including an eyelet that allows the ring to be connected to the clasping mechanism.

* * * * *